US008601695B2

(12) United States Patent
Hamburg et al.

(10) Patent No.: US 8,601,695 B2
(45) Date of Patent: Dec. 10, 2013

(54) SHAVING UNIT WITH HAIR GUIDES

(75) Inventors: Marc Hamburg, Drachten (NL); Johan Bron, Drachten (NL); Geert Geertsma, Drachten (NL); Zorka Marcan, Drachten (NL); Everhardus Johannes Hoexum, Drachten (NL); Geert Visser, Drachten (NL); Alastair Ian Blake, Drachten (NL)

(73) Assignee: Koninklijke Philips N.V., Eindhoven (NL)

( * ) Notice: Subject to any disclaimer, the term of this patent is extended or adjusted under 35 U.S.C. 154(b) by 448 days.

(21) Appl. No.: 12/282,671

(22) PCT Filed: Mar. 5, 2007

(86) PCT No.: PCT/IB2007/050702

§ 371 (c)(1),
(2), (4) Date: Sep. 12, 2008

(87) PCT Pub. No.: WO2007/105138

PCT Pub. Date: Sep. 20, 2007

(65) Prior Publication Data

US 2009/0071009 A1 Mar. 19, 2009

(30) Foreign Application Priority Data

Mar. 16, 2006 (EP) ..... 06111258

(51) Int. Cl.
*B26B 19/42* (2006.01)
*B26B 19/14* (2006.01)

(52) U.S. Cl.
USPC ..... 30/34.2; 30/43.4; 30/43.5; 30/43.6

(58) Field of Classification Search
USPC ..... 30/34.2, 43.4–43.92, 51, 54, 55, 74.1, 30/77–80, 179, 200, 202, 233, 233.5; 13/126, 141, 142, 159, 160; D28/21, D28/28, 30
See application file for complete search history.

(56) References Cited

U.S. PATENT DOCUMENTS

| | | | | | |
|---|---|---|---|---|---|
| 2,149,403 | A | * | 3/1939 | Muros | 30/43.3 |
| 2,265,305 | A | * | 12/1941 | Nyhagen | 30/43.8 |
| 3,002,276 | A | * | 10/1961 | Kobler | 30/43.92 |
| 4,146,960 | A | * | 4/1979 | Flowers et al. | 30/195 |
| 4,189,832 | A | * | 2/1980 | Harper et al. | 30/34.2 |
| 4,310,968 | A | * | 1/1982 | Buik et al. | 30/34.2 |
| 4,888,870 | A | * | 12/1989 | Fujikawa et al. | 30/233.5 |

(Continued)

FOREIGN PATENT DOCUMENTS

| | | | |
|---|---|---|---|
| CN | 101400487 B | * | 9/2011 |
| EP | 1998938 B1 | * | 6/2011 |

(Continued)

*Primary Examiner* — Jason Daniel Prone

(57) ABSTRACT

A shaving unit has at least one cutter (10, 12) for cutting hairs (11), a guide surface (4) extending closely adjacent the cutter or cutters (10, 12), and hair guides (3) projecting from the guide surface (4). The hair guides (3) bound channels (5) extending from an area spaced from the cutter or cutters (10, 12) towards the cutter or cutters (10, 12), and the hair guides each have a skin contact surface (6) facing away from the guide surface (4) and a surface (16) facing the guide surface (4), wherein the skin contact surface (6) is at least partially round and meets the surface (16) facing the guide surface (4) along a hair catching edge (7).

6 Claims, 2 Drawing Sheets

(56) References Cited

U.S. PATENT DOCUMENTS

| | | | | |
|---|---|---|---|---|
| 5,345,644 | A * | 9/1994 | Gueret | 15/DIG. 5 |
| 5,386,750 | A | 2/1995 | Morrison | |
| 5,694,953 | A * | 12/1997 | Stephan et al. | 132/160 |
| 5,771,904 | A * | 6/1998 | Lange et al. | 132/159 |
| 5,802,721 | A | 9/1998 | Wain et al. | |
| 5,884,402 | A | 3/1999 | Talavera | |
| 6,516,518 | B1 * | 2/2003 | Garraway et al. | 30/34.2 |
| 6,868,611 | B2 * | 3/2005 | Geertsma et al. | 30/43.6 |
| 2002/0092173 | A1 * | 7/2002 | Zuidervaart et al. | 30/34.2 |
| 2010/0299859 | A1 * | 12/2010 | Kastl | 15/207.2 |
| 2010/0299937 | A1 * | 12/2010 | Geiser et al. | 30/233.5 |
| 2011/0016729 | A1 * | 1/2011 | Geiser et al. | 30/233.5 |

FOREIGN PATENT DOCUMENTS

| | | | |
|---|---|---|---|
| ES | 2367047 | T3 * | 10/2011 |
| JP | 09173667 | A | 7/1997 |
| JP | 2009529943 | A * | 8/2009 |
| WO | WO 2007105138 | A2 * | 9/2007 |

* cited by examiner

SHAVING UNIT WITH HAIR GUIDES

The invention relates to a shaving head comprising at least one cutter and hair guides.

Shavers equipped with hair guides for catching hairs and keeping the caught hairs in an orientation projecting from the skin so as to allow the hairs to be reliably cut off by the cutters are known in the art, both with safety razors and electrical razors.

Electrical hair cutting devices, such as shavers and trimmers, generally have a housing containing a motor for driving rotatable or vibratingly movable cutters in one or more shaving heads at an end of the housing. Hairs protruding through the apertures of an essentially stationary external cutter are cut off between the external cutter and the internal cutter moving along the external cutter.

In U.S. Pat. No. 4,310,968, a shaver is disclosed that is equipped with a brush for straightening the hairs to be shaved. The brush has bristles having hook-shaped ends for engaging the hairs. By moving the shaving head over the skin the hook-shaped ends of the bristles engage bent hairs or hairs which lie flat against the skin and pull the hairs into an orientation projecting more from the skin. Thus, the cutters of the shaver can cut the hairs more reliably.

From practice, foil shavers are known that are equipped with a plurality of flanges perpendicular to a closest border of the external cutter. When the shaver is moved over the skin, these flanges stretch the skin to be shaved prior to the passage of the cutters and orient hairs to enhance the cutting action of the cutters.

A problem of guides for the positioning of hairs to be cut is that the guides either irritate the skin or are not very effective at presenting hairs to the cutters in a position that allows the hairs to be cut off reliably and closely along the skin.

It is an object of the invention to provide a solution that provides an effective hair guiding action while causing less skin irritation than would conventionally be associated with such hair guiding effectiveness.

According to the present invention, this object is achieved by providing a shaving unit according to claim 1.

The round surface of the guide provides a smooth contact between the guide and the skin (which may be depressed and/or form a bulge upstream of the contact areas between the guides and the skin), so that no or little irritation is caused. The round surface presses down the skin under the guide, at the same time making the skin bulge upward along the sides of the guide and past the hair catching edge.

Due to the bulging of the skin along the sides of the guides, the hair catching edges are able to engage hairs which lie flat against the skin and position them before they are cut by the razor blades without intensively scraping over the skin.

Particular embodiments of the invention are set forth in the dependent claims.

Further aspects, effects and details of the invention are set forth in the detailed description with reference to examples, of which some are shown in the drawings.

Figure 1:
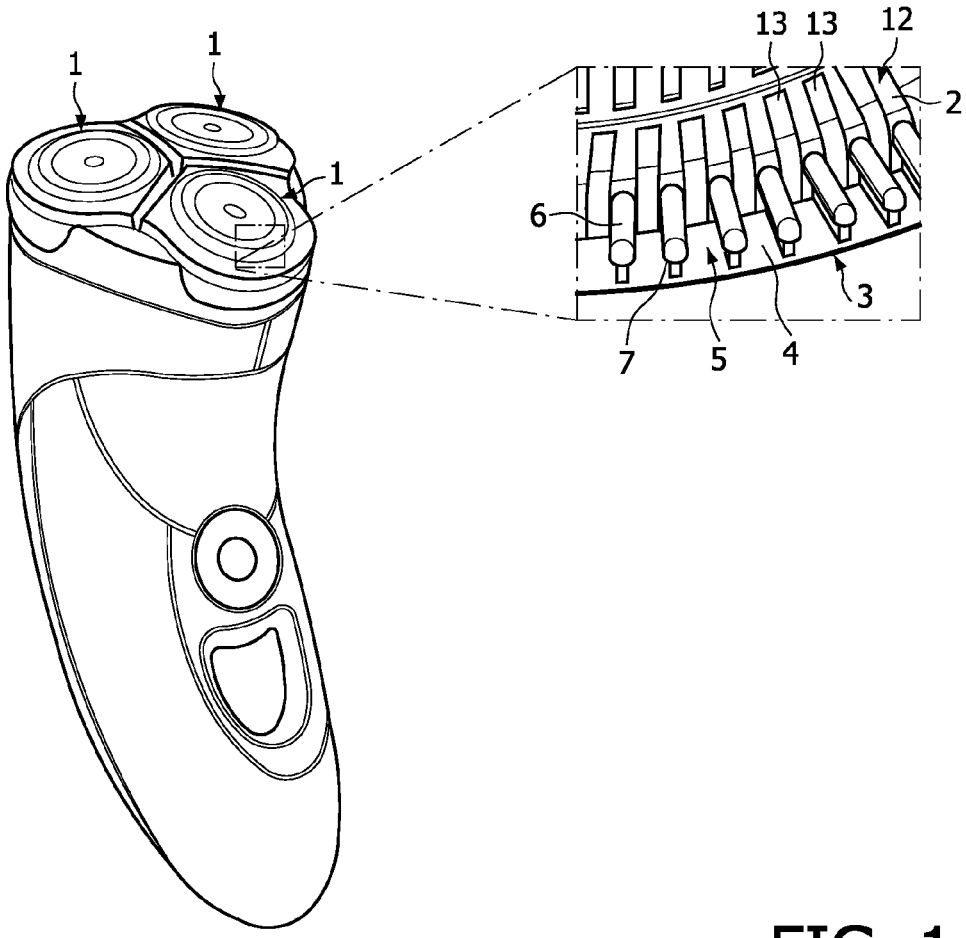
FIG. 1 is a schematic perspective view, with an enlarged detail, of an example of a shaver including a shaving unit according to the invention.
Figure 2:
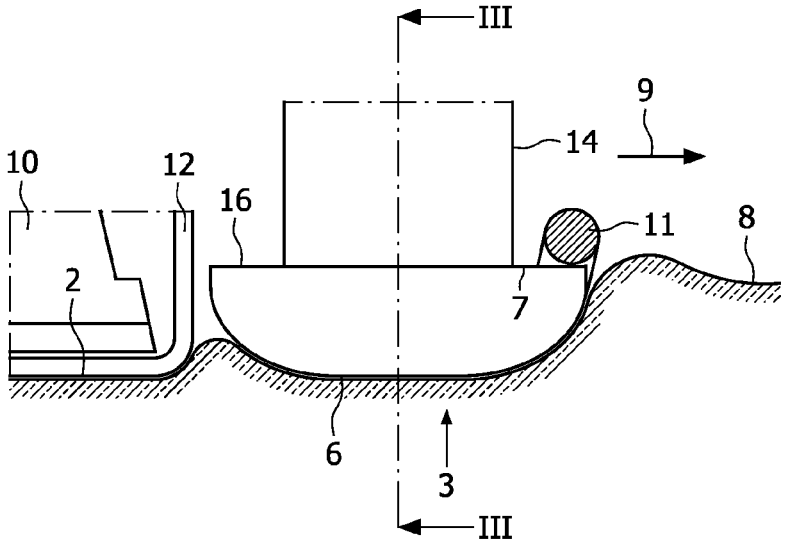
FIG. 2 is a schematic side view of a hair guide and of a portion of a shaving unit of the shaver according to FIG. 1.
Figure 3:
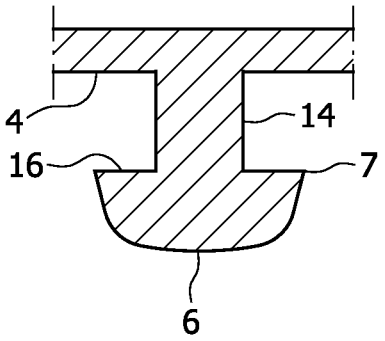
FIG. 3 is a side view in cross-section along the line III-III in FIG. 2.

The shaving apparatus shown in FIGS. 1-3 has a shaving unit including three shaving heads 1 and a cap in which the shaving heads 1 are suspended. Each shaving head 1 has a stationary, external cutting member or shear plate 12 having hair-entry apertures 13, and a driven cutting member 10. The cutting members 10, 12 are elastically suspended so that the cutting members 10, 12 can be pressed into a position such that the external surface 2 of the external cutting member 12 is about flush with surfaces of the cap. This provides a limitation of the maximum contact pressure between the external cutters 12 and the skin 8 that is normally exerted during use. The movable cutter 10 is drivable for movement along an inner surface of the external cutter 12, in a known manner, by means of an electric motor, (not shown), so that a hair 11 caught in a hair-entry aperture 13 is cut off by co-operation of the cutting elements 10, 12.

Closely adjacent to an external cutter 12, hair guides 3 project from a guide surface 4. The guides 3 bound channels 5 extending from an area spaced from the shaving area 2 towards the shaving area 2.

The guides 3 each have a skin contact surface 6 that is partially round and faces away from the guide surface 4 and a surface 16 facing towards the guide surface 4. The skin contact surface 6 and the surface 16 facing the guide surface 4 meet along a hair catching edge 7. In the present example, the hair catching edge 7 is a sharp edge (sharp in the sense of not being blunt), and preferably at least as sharp as can be achieved by normal injection molding of the hair guides without special measures or after-treatment such as grinding or milling.

The term "round" is used here in the sense that the curvature of the surface is such that the outside of the curvature is on the outside of the surface.

As is best seen in FIGS. 2, 3, in the present example, the hair guides 3 each have a generally mushroom-shaped cross-section with a flange 14 between the guide surface 4 and a guide portion of the hair guide 3 having the skin contact surface 6 and the surface 16 facing away from the guide surface 4. The guide portion is wider and longer than the flange 14.

FIG. 2 illustrates how a hair guide 3 of the shaving unit according to the present example slides over the skin. The direction of movement over the skin 8 is indicated by an arrow 9.

The skin contact surface 6 has a round shape, so that the skin contact surface 6 slides over the skin 8 smoothly, even though the skin 8 is locally depressed and a bulge may form in front of the guides 3. Because of the curvature of the skin contact surface 6, the hair catching edge 7 is located less far from the guide surface 4 than the portions of the skin contact surface 6 that are most remote from the guide surface 4. This keeps the hair catching edge 7 from scraping over the skin with substantial pressure (depending on the skin properties, some slight scraping may still occur more or less occasionally). Nevertheless, because the hair guide 3 is in practice depressed slightly into the skin 8 and the skin tends to bulge 8 in front of the hair guides 3 and into the channels 5 between the hair guides 3, the hair catching edge 7 reliably engages hairs 11 lying flat on the skin when the shaving unit is moved over the skin. In cooperation with the surface 16 facing the guide surface 4, the hair catching edge 7 guides the hairs 11 into an orientation that allows the hairs 11 to be reliably cut off close to the skin 8.

To account for the bulging of the skin in front of and to the sides of the hair guides, the distance, measured perpendicularly to the guide surface 4, between the hair cutting edge 7 and the portion of the skin contact surface 6 most remote from the guide surface 4 is preferably between 0.1 mm and 1.0 mm.

The external cutter 12 is pressed into the cap to a position as shown, in which the outer surface 2 of the external cutter 12 extends approximately in the same plane as the portions of the hair guides 3 most remote from the guide surface 4. The apertures 13 in the shear plate 12 leave room for the skin 8 to bulge through a little, so that the driven cutting member 10 can cut hairs close to the skin surface.

When the shaving unit is moved over the skin 8, the skin surface moves along the hair catching edge 7. The hair catching edge 7 of a hair guide 3 is thus capable of catching a hair 11 lying on the skin 8 and across its path at an angle to the direction of movement 9 of the hair guide 3. When the hair guide 3 moves on, the hair 11 is kept in a position such that it projects from the skin 8 by the relatively wide guide portion of the hair guide 3 passing between the hair 11 and the skin 8 until it is cut off by the cutters 10, 12.

To avoid that short hairs 11 are released by the hair guides 3 prior to being cut off, the distance between the hair guides 3 and the closest one of the cutters 10, 12 is preferably smaller than or equal to 1 mm (this corresponds to about 24 hours beard growth). Also, for reliably cutting off caught hairs, it is advantageous that the apertures 13 in the stationary cutter member 12 are each in line with one of the channels 5, so that caught hairs can easily enter the apertures 13 in the stationary cutter member 12.

In the present example, the hair guides 3 are elongate and oriented in a direction towards the cutters 10, 12, so that the hair guides 3 may be narrow, but nevertheless constitute a sufficiently large total skin contact surface area to maintain the contact pressure between the skin contact surfaces 6 and the skin 8 at a level that does generally not cause skin irritation. Furthermore, the fact that also the channels 5 are elongated and oriented in a direction towards the shaving area also contributes to the effect of providing many hair-catching edges while keeping skin pressure limited.

Seen in cross-section, the section of the skin contact surface 6 directly along the hair catching edge 7 and the surface 16 facing towards the guide surface 4 preferably enclose an angle of at most 110 degrees. This is favorable for reliably catching hairs and maintaining hairs in an upright position, until the cutters 10, 12, reach the hairs. On the other hand, for counteracting skin irritation, it is preferred that this enclosed angle is at least 50 degrees and more preferably at least 60 degrees.

For smooth sliding of the hair guides over the skin, it is advantageous if the smallest radius of curvature of the skin contact surface 6 is larger than 0.1 mm and preferably larger than 0.2 mm.

Figure 4:
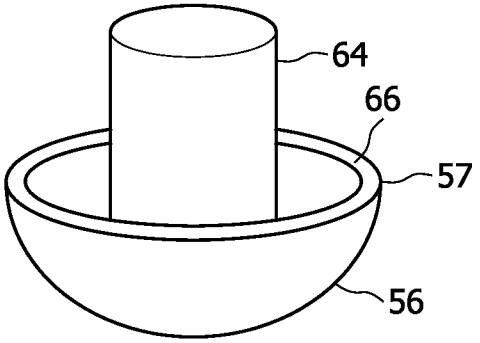
FIG. 4 is a perspective view of a hair guide of a second example of a shaving unit according to the invention.

In FIG. 4, a hair guide of a second example of a shaving unit according to the invention is shown. According to this example, the hair guide is not elongate, the hair contact surface 56 forms a section of a sphere and the hair catching edge 57 forms a circle. The stem 64 of this hair guide is of a cylindrical shape and the surface 66 facing away from the guide surface is only a narrow ring extending along the hair catching edge 57.

Figure 5:
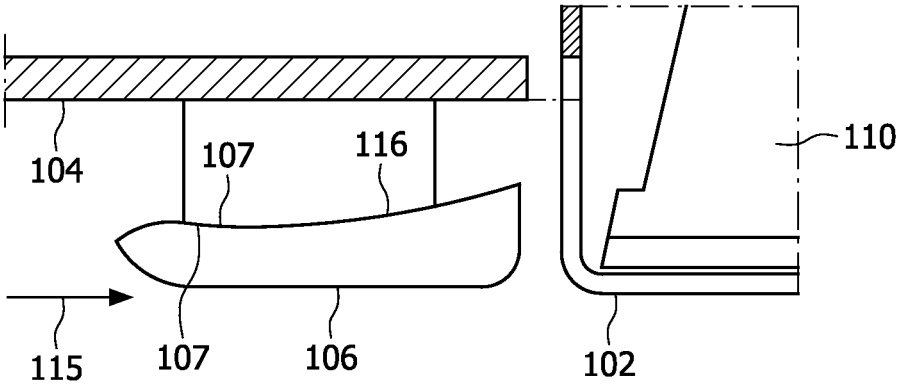
FIG. 5 is a schematic side view of a hair guide and of a portion of a third example of a shaving unit according to the invention.

In FIG. 5, a section of yet another example of the shaving unit according to the present invention is shown. In this example, the hair catching edge 107 has a front end that is more remote from the guide surface 104 than the rear end. If the hair guide is moved over the skin, hairs that approach the hair guide in a direction indicated by arrow 115 are reliably caught by the front end and gradually lifted as they pass along the hair catching edge 107 and/or the surface 116 facing the guide surface 104, to be reliably led to the cutters to be cut off by cutter 110. The round portion of the skin contact surface 106 has a larger radius of curvature at its forward end than at its end adjacent the cutters. In operation, the stationary one of the cutters is in a position where its outer surface 102 is approximately in the same plane as the skin contact surface 106.

From the foregoing, it will be clear to the skilled person that within the framework of the invention as set forth in the claims, also many variations other than the examples described above are conceivable. For instance, the hair guides may be provided in the form of one or more exchangeable parts releasably connectable to a shaver. Also, the guides may be provided as part of a foil shaver having an external cutter in the form of a thin, flexible mesh screen foil behind which a cutter is reciprocally movable, or in combination with a safety razor.

The invention claimed is:

1. A shaving unit comprising:

at least one driven cutter for cutting hairs, at least one stationary cutter, the stationary cutter including a plurality of apertures, a guide surface extending adjacent said at least one stationary cutter, and elongated hair guides projecting from the guide surface, said elongated hair guides being spaced apart from each other and bounding channels defined by the spaces between the elongated hair guides extending from an area spaced from the at least one stationary cutter towards the at least one stationary cutter, wherein the elongated hair guides are configured so that each of the channels bounded by the elongated hair guides is elongated and radially aligned with a respective one of the plurality of apertures of the at least one stationary cutter, and each of the hair guides having a skin contact surface facing away from the guide surface and a surface facing the guide surface, wherein the skin contact surface is at least partially round and meets the surface facing the guide surface along a hair catching edge, wherein for each of the hair guides a distance, perpendicular to the guide surface, between the hair catching edge and a portion of the skin contact surface most remote from the guide surface is between 0.1 and 1.0 mm.

2. A shaving unit according to claim 1, wherein, for each of the hair guide, a section of the skin contact surface adjacent to the hair catching edge and the surface facing the guide surface enclose an angle of at most 110 degrees.

3. A shaving unit according to claim 1, wherein the elongated hair guides are elongated and oriented in a direction towards the at least one stationary cutter.

4. A shaving unit according to claim 1, wherein a distance between the elongated hair guides and the at least one stationary cutter is smaller than or equal to 1 mm.

5. A shaving unit according to claim 1, wherein a smallest radius of curvature of the at least partially round portion of the skin contact surface is larger than 0.1 mm.

6. A shaver comprising a shaving unit according to claim 1.

* * * * *